United States Patent [19]

Nelson

[11] Patent Number: 4,732,670

[45] Date of Patent: Mar. 22, 1988

[54] TENSIONING ASSEMBLY FOR VIBRATORY SCREENS

[75] Inventor: Robert D. Nelson, Princeton, Ill.

[73] Assignee: Production Engineered Products, Inc., Walnut, Ill.

[21] Appl. No.: 869,461

[22] Filed: May 28, 1986

Related U.S. Application Data

[63] Continuation of Ser. No. 667,266, Nov. 1, 1984, abandoned.

[51] Int. Cl.[4] ..... B07B 1/49

[52] U.S. Cl. ..... 209/314; 209/403; 209/404

[58] Field of Search ..... 209/403, 402, 394, 398, 209/311, 313, 314, 395, 399, 400, 405, 401, 357, 320, 346–349, 404; 160/378, 328, 395; 52/222; 38/102.1; 101/128.1, 127.1, 415.1

[56] References Cited

U.S. PATENT DOCUMENTS

| | | | |
|---|---|---|---|
| 1,085,043 | 1/1914 | Hodgdon | 209/405 |
| 1,852,677 | 4/1932 | Reynolds | 335/278 |
| 2,000,426 | 5/1935 | Symons | 209/403 |
| 2,077,678 | 4/1937 | Delamater | 209/346 |
| 4,133,751 | 1/1979 | Stengel | 209/404 |
| 4,137,157 | 1/1979 | Diester et al. | 209/403 |
| 4,444,656 | 4/1984 | Nelson et al. | 209/347 |
| 4,529,510 | 7/1985 | Johnson et al. | 209/405 |

FOREIGN PATENT DOCUMENTS

| | | | |
|---|---|---|---|
| 411781 | 4/1925 | Fed. Rep. of Germany | 209/346 |
| 591470 | 1/1934 | Fed. Rep. of Germany | 209/400 |
| 608376 | 1/1935 | Fed. Rep. of Germany | 209/403 |
| 2720296 | 12/1978 | Fed. Rep. of Germany | 209/322 |
| 31854 | 1/1962 | Finland | 209/403 |
| 1017072 | 12/1952 | France | 209/314 |

*Primary Examiner*—Kenneth M. Schor

*Attorney, Agent, or Firm*—Lockwood, Alex, FitzGibbon & Cummings

[57] ABSTRACT

An improved classifying apparatus and assembly for the tensioning of vibratory screens includes a rigid frame, a pair of classifying screens in the frame and means for tensioning the screens. The improvement in the means for tensioning the screens includes a stationary anchor at one end of the screens and elongate rotatable elements adjacent the other ends of the screens. Levers are mounted to the ends of the rotatable elements outside of the frame and a tensioning cable extends between the levers. A tensioning member is positioned in the cable which, when adjusted, rotates the rotatable elements to simultaneously and uniformly adjust the tension on the screens.

7 Claims, 2 Drawing Figures

TENSIONING ASSEMBLY FOR VIBRATORY SCREENS

This application is a continuation of application Ser. No. 667,266, filed Nov. 1, 1984, now abandoned.

BACKGROUND AND SUMMARY OF THE INVENTION

The present invention relates generally to vibratory material-screening apparatus used in classifying solid particulate matter and, more particularly, to a vibratory screen tensioning assembly for use in such apparatus.

Vibrating screening decks have been widely used in the past for the classification and separation of particulate solids of varying particle sizes and compositions, such as limestone, coal and other ores. Such screening decks have typically comprised a generally rectangular frame which is suspended in operation and which has one or more screen cloth decks in the frame upon which the materials to be classified are deposited. The frame and screens in such decks are suspended at a angle and the entire frame with its screens is vibrated to cause the solid particulates to move down the screens. As the materials move down the vibrating screen, solids of smaller mesh size pass through the screen as "unders" and solids of larger dimensions are discharged from the lower end of the screen as "overs".

In U.S. Pat. No. 4,444,656 an improved vibrating screening deck assembly is disclosed in which one or more wire cloth screens having a preselected mesh size to allow the passage therethrough of material are anchored at opposite ends to spaced members extending transverse to the frame walls. In such assembly one end of the screen is anchored and the screen is stretched across one or more tappet assemblies that also span the width of the frame and the other end of the screen is anchored at its opposite end. The tappet assemblies underlie the screen to impart vibration directly to the screen, rather than to the frame, and the tappet assemblies support the screen. To achieve optimum operation of the classifying apparatus the screens must be tensioned uniformly to provide a uniform screening surface. Therefore, the screens in such assemblies perferably should include some sort of means for tensioning the screen over the tappet assemblies.

In U.S. Pat. No. 4,444,656 such tensioning is accomplished by a tensioning plate having a width substantially equal to that of the screen. The plate has a hooked flange that engages a similar hooked flange on the screen ends and a plurality of tensioning bolts by which the screen tension is adjusted by turning individual bolts laterally spaced across the screen.

Although the last mentioned tensioning arrangement is capable of satisfactory adjustment of the screen tension, it suffers several shortcomings. One such shortcoming is that the tension that can be imparted to the screen deck is limited by the length of the tensioning bolts. Additionally, the adjustment of all of the bolts must be uniform to ensure that a uniform tension is applied to the screen and each of the bolts must be individually adjusted which is time consuming and usually requires that the assembly be placed out of operation. The foregoing shortcomings are compounded, where multiple screen decks are employed. Moreover, the need to place the assembly out of operation during adjustment is, itself, disadvantageous because adjustment would be faster and more accurate if it was accomplished during operation so the effects of adjustment could be instantaneously observed during operation.

The tensioning assembly of the present invention overcomes the aforementioned shortcomings. In a tensioning assembly incorporating the principles of the present invention, screen tension adjustment may be accomplished rapidly and uniformly and without the need to place the assembly out of operation. Moreover, such adjustment may be accomplished over a wide range of adjustments. Additionally, where multiple screens are present, they can be tensioned simultaneously so that each individual screen receives an equal amount of tension and total adjustment time is reduced.

In one principal aspect of the present invention, a classifying apparatus includes a rigid frame, at least one classifying screen in the frame, and means for tensioning the screen. The improvement in the means for tensioning the screen comprises means for stationarily anchoring one end of the screen and elongate rotatable mean adjacent the other end of the screen and extending across the width of the screen and the frame. The rotatable means includes engaging means for engaging the other end of the screen substantially across the width of the screen. Mounting means for mounting the elongate rotatable means for rotation relative to the frame is provided along with means for rotating the rotatable means to draw a tension on the screen when the screen is anchored at one end and engaged at its other end by the engaging means.

In another principal aspect of the present invention, the aforementioned apparatus includes a pair of screens in the frame and means for stationarily anchoring one end of each of the screens. Elongate rotatable means, one for each screen, are positioned adjacent the other end of each of the screens and extend across the width of the screens and the frame. The rotatable means include engaging means for engaging the other end of the respective screens substantially across the width of the screens. Mounting means for mounting the elongate rotatable means for rotation relative to the frame and means for rotating the rotatable means to draw a tension on each of the screens when said screens are anchored at their one end and engaged at their other end by the engaging means are provided.

In still another principal aspect of the present invention, the aforementioned rotatable means extend beyond and to the side of the frame opposite the screens, and the means for rotating the rotatable means are also on the last mentioned side.

In still another principal aspect of the present invention, the aforementioned means for rotating the rotatable means comprises a lever on each of the rotatable means.

In still another principal aspect of the present invention, the aforementioned means for rotating the rotatable means includes a tensioning cable attached between the levers, and tensioning means on the cable for selectively tensioning the cable, whereby both of the rotatable means are rotated simultaneously and the screens are simultaneously tensioned.

In still another principal aspect of the present invention, the apparatus includes a pair of cables, one on each side of the frame.

In still another principal aspect of the present invention, the aforementioned ends of the screens are releasably anchored and engaged, respectively.

These and other objects, features and advantages of the present invention will be clearly understood through a consideration of the following detailed description.

BRIEF DESCRIPTION OF THE DRAWINGS

In the course of this description, reference will frequently be made to the attached drawings in which.

DESCRIPTION OF THE PREFERRED EMBODIMENT

Figure 1:
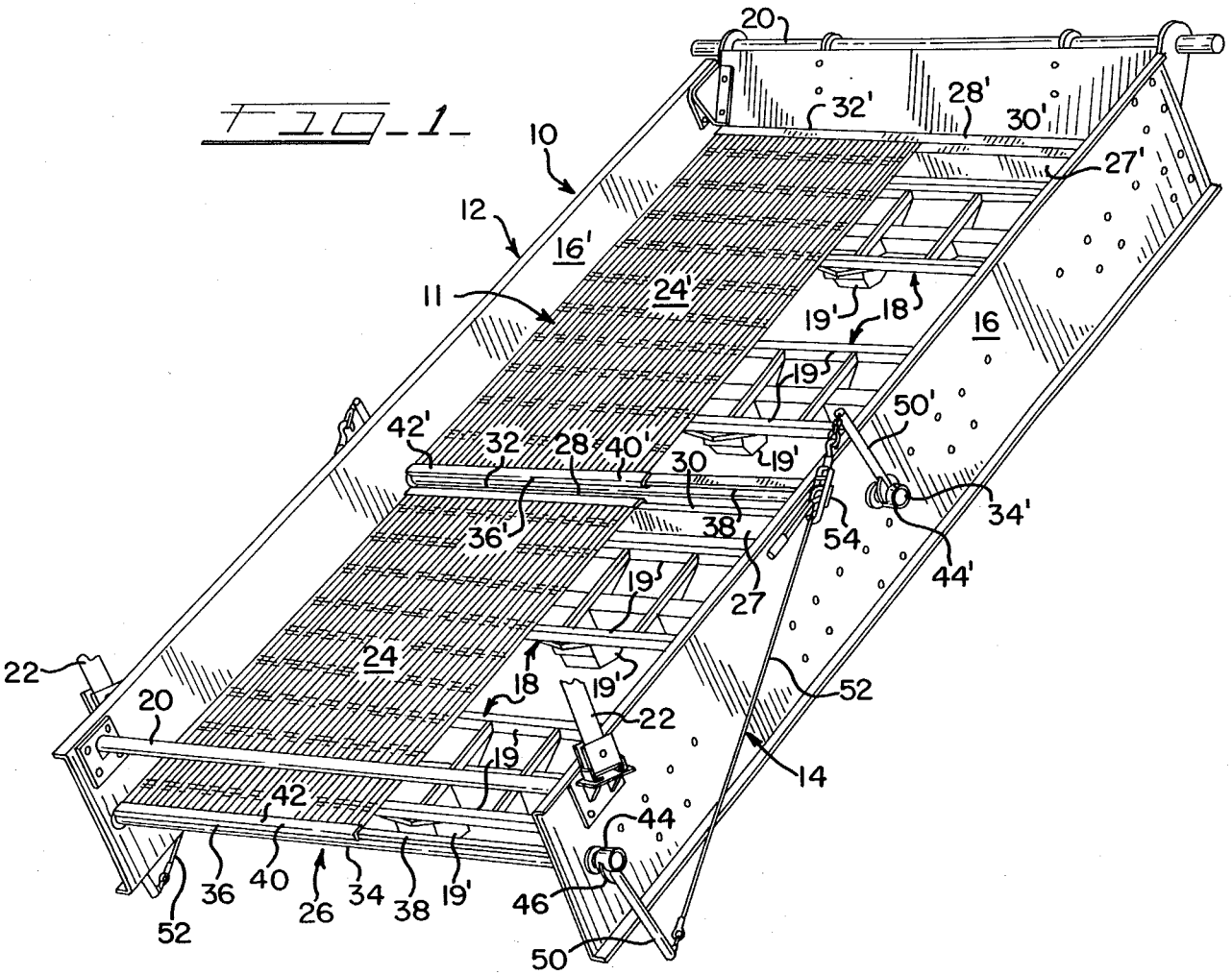
FIG. 1 is an overall perspective view of a classifying apparatus incorporating a preferred embodiment of tensioning assembly in accordance with the principles of the present invention and in which the screen deck has been partially cut away to show the components of the deck that underlie the screens.

An overall perspective view of a classifying apparatus 10 including a preferred embodiment of the tensioning assembly 14 incorporating the principles of the present invention is shown in FIG. 1. Generally, the classifying apparatus 10 comprises a vibrating screening deck 11 mounted within a frame 12. The classifying apparatus shown is similar to that shown in the aforementioned U.S. Pat. No. 4,444,656 for purposes of convenience and, as such, the apparatus in general does not form a principal part of the present invention. Accordingly, the classifying apparatus 10 will be described in general terms only, it being understood that apparatus other than that shown in the drawings may be selected by persons skilled in the art without departing from the principles of the invention.

The classifying apparatus 10 includes a pair of longitudinally extending elongate frame sidewalls 16, such as channel beams as shown in FIG. 1. The elongate frame walls 16 are spaced apart in generally parallel relationship to each other by vibrating tappet assemblies 18 beneath the screening deck as shown in FIG. 1. The tappet assemblies 18 include spaced tappet bars 19 extending transversely between the frame members 16 and vibrators 19' for vibrating the tappet assemblies 18 and the screening deck 11 which lies upon the tappet bars 19 and is supported by them. The details of the tappet assemblies 18 and their functions are fully described in the aforementioned U.S. Pat. No. 4,444,656, the disclosure of which is incorporated herein by reference.

The frame walls 16 are held in rigid spaced apart relationship by mounting tubes 20 which may provide the additional function of assisting in the suspension of the frame in angular relationship to a corresponding conveyor unit (not shown) which delivers the solid particulate matter to the top of the screening deck 11. Such suspension may be by way of suspension arms or cables 22, also shown in FIG. 1. The suspension cables or suspension arms may be adjusted to change the angle of inclination of the vibrating screening deck 11, depending upon the particular solids to be classified. Again, the manner of suspending the screening deck and the tappet assembly construction may take other various forms and do not form a principal part of the present invention per se.

As is conventional in classifying apparatus, some form of mesh screen, such as woven wire cloth, generally 24, 24' is mounted within the frame 12 to form the screening deck 11 over which solids to be classified are passed. It will be understood that the screening deck may also be formed of wire loops as are well known in the art, rather than the mesh screens as shown. Indeed, where the deck is formed of such loops, rapid replacement of the loops is greatly facilitated by the rotatable tensioning assembly 14 of the invention which will be described in more detail to follow. The solids will be separated and classified with the fines passing through the screens as "unders" as the material moves down the screens 24,24'. These "unders" may be collected in a pile upon the ground or in some sort of container (not shown). The larger materials which do not pass through the screens will continue to travel down the surface of the screening deck and will be discharged from the end 26 of the assembly as "overs". The "overs" also may be collected as a discrete pile upon the ground or collected in a container or the like. Such classifying apparatus may be provided with more than one screen 24, 24' to present a longer vibrating screening surface for the material. Such multiple screens may also be alternated or rotated during use to obtain the maximum life of the screens during operation.

Figure 2:
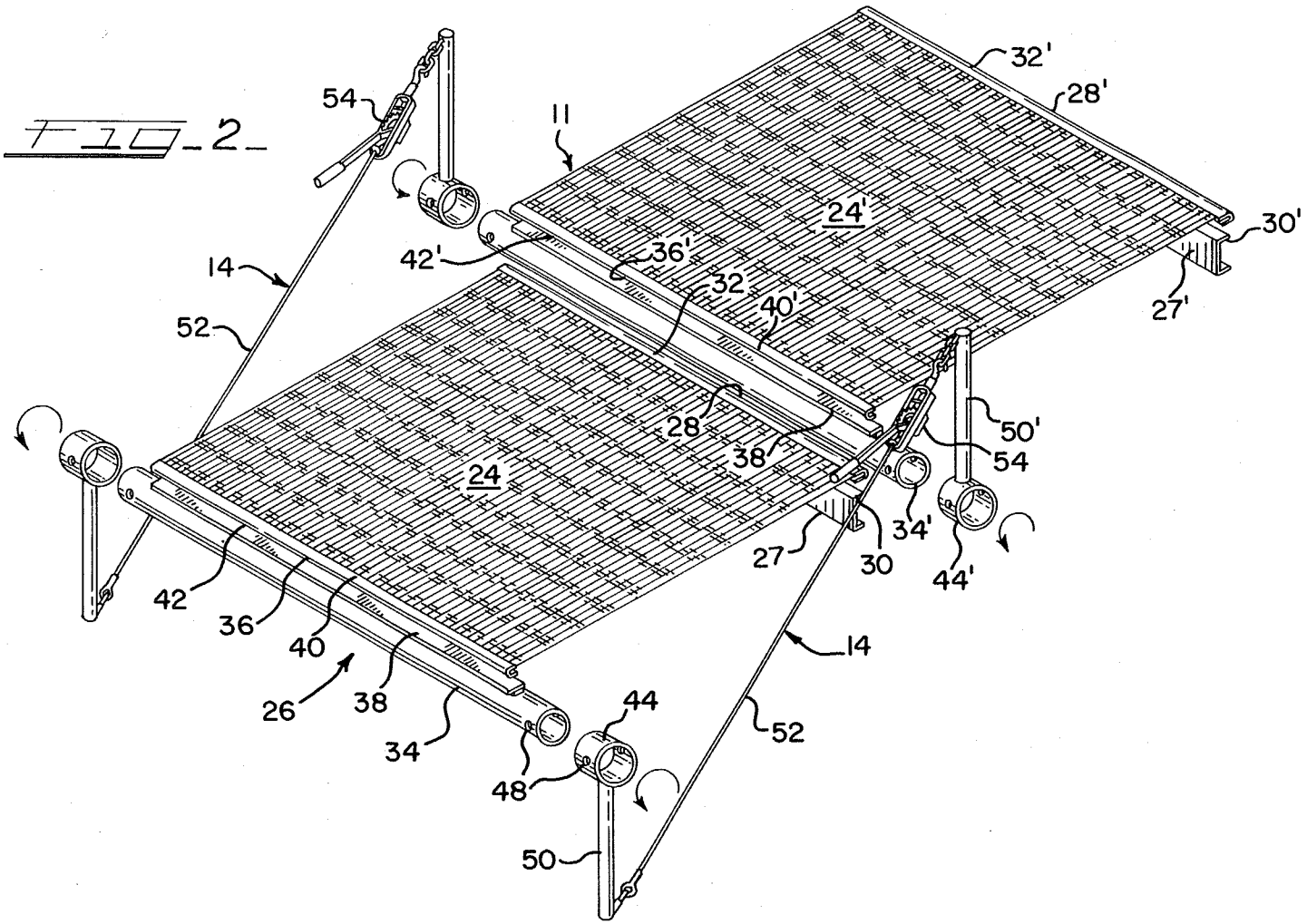
FIG. 2 is an exploded perspective view of the screen deck and tensioning assembly shown in FIG. 1 and in which the frame has been removed for clearer illustration.

FIGS. 1 and 2 illustrate a classifying apparatus in which a pair of screens 24 and 24' are employed. In the course of the following description reference will primarily be made to the components of only one of the screens 24 and those components associated with second, upper screen 24' will have reference numerals identical to those of the first screen counterparts, but in prime format, i.e., 24'.

The assembly thus far described is known and is essentially disclosed in the aforementioned U.S. Pat. No. 4,444,656. The present invention is directed to an improved screen tensioning assembly that may be incorporated in such apparatus or other screening assemblies.

The tensioning assembly 14 of the present invention includes a pair of rigid stationary beams 27 and 27' extending between the frame walls 16 at one end 28,28' of the respective screens 24,24'. Each of the beams 27,27' is preferably channel shaped in cross section having a flange 30,30' extending rearwardly toward the upper end of the assembly and adjacent the top of the beams 27,27'. A complimentary flanged screen strip 32,32' borders the end 28,28' of the screens and is substantially U-shaped in cross section, as shown in FIG. 2, to hook over the flanges 30,30' and stationarily anchor the upper ends 28,28', but allow easy and rapid removal of the screens, if desired.

Elongate rotatable cylindrical elements 34,34' extend between the frame sidewalls 16 adjacent the other end 36,36' of the respective screens. These cylindrical elements 34,34' are mounted for rotation in the frame sidewalls 16 and include an elongate flange 38,38' thereon which preferably extends substantially across the width elements 34,34', the frame and the screening deck 11. These flanges 38,38' are adapted to rotatably engage flanged U-shaped strips 40,40', respectively, at the other lower ends 42,42' of the respective screens 24,24' and substantially across their width.

The cylindrical elements 34,34' extend through the frame sidewalls 16,16' to the exterior side of the frame and sleeves 44,44' are preferably fixed to each end of the elements 34,34', such as by a pin 46 through holes 48. A lever 50,50' is firmly affixed, as by welding, to each of the sleeves 44,44'. Lever 50 preferably extends downwardly and lever 50' upwardly as shown in the drawings. Thus, rotation of the levers 50,50' will rotate the sleeves 44,44', their cylindrical elements 34,34', and because the element flanges 38,38' are hooked into the strips 40,40', the respective screens can be tensioned or relaxed as desired across the width of the screening deck.

A tensioning cable 52 extends between the levers 50 and 50' preferably on each side of the assembly to apply a uniform tension across the entire width of the screening deck. Each of the cables 52 includes a tensioning member 54, such as a ratcheted cable hoist puller as shown in the drawings. Such hoist puller will not be described in detail because it is conventional. In lieu of a hoist puller, it will be understood that other suitable cable tensioning members may be employed, such as turnbuckles.

Although a pair of tensioning cables 52 are shown in the drawings with one on each side of the frame, only one such cable may be employed without departing from the invention. A pair of cables 52 are, however, preferred because the tension may be adjusted from either side of the apparatus. A pair of such cables also enable compensation for any variation in screen tension across the width of the screens which might occur, if torsion is present in the rotatable elements 34,34' upon high degrees of tension adjustment. Normally such torsion would not even occur, however, particularly if the elements are formed of heavy duty material.

It will also be understood that the rotatable elements 34,34' may be of a cross section other than cylindrical as shown and that the levers 50,50' may be attached directly to the ends of the elements 34,34', rather than by sleeves 44,44'.

Although it is believed that from the foregoing description, the operation of the tensioning assembly 14 of the present invention will be clearly understood, a brief description of the tensioning operation follows.

The screen strips 32,32' of each of the screens 24,24' are first stationarily anchored in the apparatus by hooking the U-shaped strips over the flanges 30 and 30', respectively, of the beams 27 and 27'. The strips 40 and 40' at the opposite ends of the screens 24 and 24' are next engaged with the flanges 38,38' on the rotatable cylindrical elements 34,34', respectively.

Once the later strips 40,40' are so engaged, the tensioning cable 52 on each side of the frame is tensioned so as to remove the slack from both cables. Once the slack has been removed, the tensioning cables may be further selectively tensioned on each side of the machine so as to draw a uniform tension across the width of the screens 24,24'. Because the levers 50 and 50' on each side of the frame extend in opposite directions as shown in the drawings, both will rotate in the counterclockwise direction as shown by the arrows to cause the rotatable cylindrical elements 34,34' to rotate so as to simultaneously adjust the tension on both screens.

From the foregoing it will be appreciated that adjustment of the tension on both screens 24 and 24' may be accomplished simultaneously and while the classifying assembly is in operation. Thereby, the speed and accuracy of such adjustment is substantially facilitated. Moreover, it will also be appreciated that the adjustment of tension is simultaneous across the width of the screen and the need for individual spaced adjustment across the screen width is obviated. It will be also appreciated that each of the screens 24,24' may be rapidly disassembled from the apparatus and rotated to optimize maximum screen life.

It will be understood that the embodiment of the present invention which has been described is merely illustrative of one of the applications of the principles of the invention. Numerous modifications may be made by those skilled in the art without departing from the true spirit and scope of the invention.

What I claim is:

1. In a classifying apparatus including a rigid frame, at least a pair of classifying screens in the frame positioned such that overs from one to said screens travels from that screen to the other of the screens, and means for tensioning the screens, wherein the improvement in the means for tensioning the screens comprises:

means for stationarily anchoring one end of each of said screens;

elongate rotatable means, one for each of said screens, adjacent the other end of each of said screens and extending across the width of the screens and said frame, each of said rotatable means including engaging means for engaging the other end of each of the screens substantially across the width of the screens;

mounting means for mounting said rotatble means for rotation relative to the frame; and means for simultaneously rotating said rotatable means in the same direction as each other for simultaneously drawing a tension on each of said screens when said screens are anchored at one end and engaged at their other end by said engaging means, said means for rotating being connected to each of said rotatable means such that the means for rotating, when tensioned, simultaneously rotates said rotatable means in the same direction as each other.

2. The apparatus of claim 1, wherein said rotatable means extends beyond and to the side of said frame opposite said screens, and said means for rotating said rotatable means is also on said last mentioned side.

3. The apparatus of claim 1, wherein said means for rotating said rotatable means comprises a lever on each said rotatable means.

4. The apparatus of claim 3, wherein said means for rotating said rotatable means includes a tensioning cable attached between said levers, and tensioning means on said cable for selectively tensioning said cable, whereby both of said rotatable means are rotated simultaneously and said screens are simultaneously tensioned.

5. The apparatus of claim 4, wherein said tensioning means comprises a cable hoist puller.

6. The apparatus of claim 4, comprising a pair of said cables, one on each side of said frame.

7. The apparatus of claim 1, wherein said one end of said screens is releasably anchored by said means for stationarily anchoring said one end and said other end of said screens is releasably engaged by said engaging means.

* * * * *